US008322732B2

(12) United States Patent
McKay et al.

(10) Patent No.: US 8,322,732 B2
(45) Date of Patent: Dec. 4, 2012

(54) PORTABLE WORKSTATION

(75) Inventors: Jodi McKay, Charlotte, NC (US); Robert McKay, Charlotte, NC (US); Brett Rhinehardt, Charlotte, NC (US); Daniel Lee Bizzell, Davidson, NC (US); Ian D. Kovacevich, Charlotte, NC (US); Tom Philpott, Charlotte, NC (US)

(73) Assignee: BradyQuin, LLC, Charlotte, NC (US)

( * ) Notice: Subject to any disclaimer, the term of this patent is extended or adjusted under 35 U.S.C. 154(b) by 612 days.

(21) Appl. No.: 12/429,390

(22) Filed: Apr. 24, 2009

(65) Prior Publication Data

US 2009/0200902 A1 Aug. 13, 2009

Related U.S. Application Data

(63) Continuation-in-part of application No. 11/424,839, filed on Jun. 16, 2006, now abandoned.

(51) Int. Cl.
*B62B 3/02* (2006.01)

(52) U.S. Cl. ..... 280/47.35; 280/47.34

(58) Field of Classification Search ..... 280/47.35, 280/47.34, 47.18

See application file for complete search history.

(56) References Cited

U.S. PATENT DOCUMENTS 1,100,983 A * 6/1914 Miles ..... 312/230
1,943,282 A * 1/1934 Bellavia ..... 312/222
2,190,498 A * 2/1940 Williams ..... 312/243
3,856,320 A * 12/1974 Blanchard ..... 280/47.35
4,050,752 A * 9/1977 Dykstra ..... 312/243
4,168,103 A * 9/1979 Hagen ..... 312/219
4,317,606 A * 3/1982 Hastings ..... 312/231
4,366,687 A * 1/1983 Atkinson ..... 70/71
4,761,978 A * 8/1988 Walla ..... 70/367
4,944,552 A * 7/1990 Harris ..... 297/145
4,998,742 A * 3/1991 Maynard ..... 280/35
5,152,542 A * 10/1992 DeVoe ..... 280/47.371
5,244,267 A * 9/1993 Fossier et al. ..... 312/231
5,290,058 A * 3/1994 Adams et al. ..... 280/651
5,295,743 A * 3/1994 Moulton et al. ..... 312/297
5,314,243 A * 5/1994 McDonald et al. ..... 312/215
5,479,866 A * 1/1996 Rae ..... 108/44
5,484,293 A * 1/1996 Ford et al. ..... 434/432
5,489,106 A * 2/1996 Engelking et al. ..... 280/47.35
5,518,258 A * 5/1996 Cox ..... 280/30
5,566,961 A * 10/1996 Snell et al. ..... 280/47.35
5,611,553 A * 3/1997 Schoeman et al. ..... 280/47.35
5,634,649 A * 6/1997 Breining et al. ..... 280/47.35
5,702,115 A * 12/1997 Pool ..... 280/47.35
5,763,985 A * 6/1998 Asinovsky ..... 312/223.2
5,765,842 A * 6/1998 Phaneuf et al. ..... 280/47.35
5,848,798 A * 12/1998 Halvorson et al. ..... 280/47.35
5,887,878 A * 3/1999 Tisbo et al. ..... 280/47.19
5,927,799 A * 7/1999 Tornero ..... 297/145
5,941,713 A * 8/1999 Wayner et al. ..... 434/414
6,024,427 A * 2/2000 Underwood et al. .... 312/249.12
6,053,587 A * 4/2000 Boerder ..... 312/249.12
6,068,356 A * 5/2000 Giuseppe ..... 312/290

(Continued)

*Primary Examiner* — Jeffrey J Restifo
(74) *Attorney, Agent, or Firm* — Remenick PLLC

(57) ABSTRACT

A portable workstation includes wheels, a tabletop, a generally planar member and a chassis joining the wheels, the tabletop and the planar member. While joined to the wheels and the tabletop by the chassis, the planar member is movable between a protracted position and a retracted position. A majority of the planar member extends above the tabletop in the protracted position, and a majority of the planar member does not extend above the tabletop in the retracted position.

16 Claims, 13 Drawing Sheets

U.S. PATENT DOCUMENTS 6,129,366 A * 10/2000 Dettmann et al. ..... 280/47.35
6,264,216 B1 * 7/2001 Wilson ..... 280/30
6,296,261 B1 * 10/2001 deGoma ..... 280/47.34
6,474,665 B1 * 11/2002 Fink et al. ..... 280/79.2
6,497,423 B1 * 12/2002 Perelli et al. ..... 280/47.34
6,553,919 B1 * 4/2003 Nevin ..... 108/50.01
6,601,861 B1 * 8/2003 Dettmann et al. ..... 280/47.35
6,692,011 B2 * 2/2004 Carlson et al. ..... 280/79.2
6,739,605 B2 * 5/2004 Calmeise et al. ..... 280/47.35
7,047,890 B2 * 5/2006 Korber et al. ..... 108/50.01
7,325,891 B1 * 2/2008 Kinsley et al. ..... 312/257.1
7,338,055 B2 * 3/2008 Fuentes ..... 280/79.3
7,654,541 B2 * 2/2010 Stengel et al. ..... 280/47.19
7,665,709 B2 * 2/2010 Cvek ..... 248/669
7,784,412 B2 * 8/2010 Korber et al. ..... 108/25
2002/0096845 A1 * 7/2002 Spann ..... 280/79.2
2004/0119257 A1 * 6/2004 Nelson et al. ..... 280/47.35
2005/0110461 A1 * 5/2005 McConnell et al. ..... 320/116
2005/0140106 A1 * 6/2005 Huguet ..... 280/79.3
2005/0200090 A1 * 9/2005 Ferraro et al. ..... 280/47.35
2008/0000171 A1 * 1/2008 McKay et al. ..... 52/36.1
2008/0315734 A1 * 12/2008 Birsel et al. ..... 312/223.3
2009/0200902 A1 * 8/2009 McKay et al. ..... 312/249.12
2011/0079972 A1 * 4/2011 Watson ..... 280/47.4

* cited by examiner

PORTABLE WORKSTATION

I. CROSS-REFERENCE TO RELATED APPLICATION

The present application is a U.S. continuation-in-part patent application of, and claims priority under 35 U.S.C. §120 to, U.S. nonprovisional patent application Ser. No. 11/424,839, filed Jun. 16, 2006, which nonprovisional patent application published as U.S. patent application publication no. 2008/0000171 on Jan. 3, 2008, which patent application and patent application publication thereof are incorporated by reference herein.

II. COPYRIGHT STATEMENT

All of the material in this patent document is subject to copyright protection under the copyright laws of the United States and of other countries. The copyright owner has no objection to the facsimile reproduction by anyone of the patent document or the patent disclosure, as it appears in governmental files or records, but otherwise reserves all copyright rights whatsoever.

III. BACKGROUND OF THE INVENTION

Overcrowding in schools is one of the biggest problems facing the educational system today. The population of students is growing faster than school districts can build additional buildings to accommodate them. Further, most, if not all, school districts cannot afford to build new schools to accommodate the additional influx of students.

One of the tactics that schools have implemented to try to reduce the effects of overcrowding is to utilize each classroom in a school for student instruction during every hour of the school day. Conventionally, each classroom was used for teacher planning for at least one hour of the school day. Specifically, a teacher is traditionally assigned to a particular classroom from which all of that teacher's instruction is given. During the school day, such teacher has a planning period in which his or her classroom is not being used for instruction but rather for administrative tasks and planning. Schools have gone to using such classrooms during the assigned teacher's planning period for instruction by another teacher, a so-called floating teacher. A floating teacher moves from classroom to classroom and uses the empty classroom during a permanent teacher's planning period. In this situation, both the floating teacher and the students for a particular class meet in an empty classroom during the permanent teacher's planning period. There are also alternative situations wherein several floating teachers may move to a single classroom wherein a particular group of students is housed for several periods.

A problem that floating teachers face is how to store and manage their supplies. It is important that the floating teacher be able to conveniently and easily transport teaching tools and supplies from one classroom to the next. Further, it is important that such floating teacher be able to secure items for transport and storage since he or she does not have a permanent classroom in which to keep his or her items. Another issue that floating teachers face is having a display surface from which to instruct students. In a classroom typically utilized by a permanent teacher, often the blackboard or other display surfaces are being utilized by the permanent teacher. This leaves the floating teacher without a display means to utilize for instruction.

Generally, it is known to provide a mobile workstation for transporting teaching supplies, tools and the like from classroom to classroom. A well known workstation used by teachers that move from classroom to classroom is the conventional audiovideo (AV) cart which may be used as a de facto workstation used.

Another mobile workstation for teachers is disclosed in U.S. Pat. No. 6,601,861 to Dettmann, which is hereby incorporated herein by reference. The Dettmann workstation provides a mobile storage container that is transportable from classroom to classroom. The Dettmann workstation includes a planar teaching surface from which instruction can be delivered, and the Dettmann workstation provides a securable storage space for storage and transport of various types of teaching tools and the like.

Specifically, the Dettmann workstation comprises a bottom shelf panel, opposed side panels, a teaching surface panel and opposed end panels. Casters, which enable workstation mobility, are attached to the four corners of the bottom shelf panel, with two swiveling casters disposed on a first end of the workstation, hereinafter the front end of the workstation, and two fixed casters disposed on a second end of the workstation, hereinafter the back end of the workstation. The workstation also includes a handle that is integrally formed with the teaching surface panel and extends outwardly from the back end of the workstation. An auxiliary teaching surface panel, which is movable between a stored, folded position and an upright, teaching position, is disposed at the front end of the workstation. Additionally, the workstation includes detachable security panels that cover the side panels of the workstation and securely enclose the contents of the workstation. The workstation includes a power strip mounted inside the securable storage space to provide power to teaching tools that need electricity for functioning.

While presently available mobile teaching workstations are available for teachers that move from classroom to classroom, there are beneficial features that such known workstations do not provide. For example, it would be advantageous for mobile teaching workstations to provide an attached panel that may be raised to a display position to aid in instruction. As discussed hereinabove, floating teachers presently either have to use an available board in a classroom, which is often inconvenient because the board is positioned behind the permanent teacher's desk, which is interposed between the mobile teacher workstation and the permanent classroom board, or are unable to use a display board because the permanent display boards in the classroom are filled with content that the permanent teacher has displayed. Additional useful features may include a hand brake for controlling movement of said workstation and an insulated storage compartment that retains the temperature of cold or hot items placed therein.

Another tactic that schools have implemented in battling the issue of overcrowding is to utilize trailers for housing classrooms rather than building permanent buildings. One of the issues with such trailers is that they typically are not equipped to accommodate running water. This is an issue for science courses beginning as low as the middle school level because laboratory work, which requires a sink with running water, is a part of the curriculum.

In this situation, it would be advantageous to provide a mobile teacher workstation having a built-in sink with capability for self-sufficient running water. A floating science teacher can then move from classroom to classroom within the trailer or trailers and provide the running water source as he or she moved.

While unrelated to mobile teaching workstations, it is also noted that tool trolleys for use, for example, by mechanics is well known and disclosed, for example, by Breining U.S. Pat. No. 5,634,649. In this respect, Breining discloses a tool trolley for housing hand tools and other utensils. The trolley includes a frame structure and storage containers that are fitted to and supported by the frame structure.

IV. SUMMARY OF THE INVENTION

The present invention includes many aspects and features. A portable workstation that embodies one or more such aspects or features includes wheels, a tabletop and a chassis joining the wheels and the tabletop. The wheels provide for movement of the workstation and the tabletop provides a work surface of the workstation.

In an aspect of the invention, a portable workstation in accordance with the aforementioned construction further includes a design that enables a person to provide instruction aided by displaying information to students using the portable workstation as a display module. With respect to this aspect, a feature of the portable workstation includes a generally planar member that, while joined to the wheels and the tabletop by the chassis, is movable between a protracted position, wherein a majority of the planar member extends above the tabletop, and a retracted position, wherein a majority of the planar member does not extend above the tabletop.

More particularly, the planar member preferably includes a display surface, such as a dry erase board, a chalk board, a corkboard or the like, and, when in the retracted position, substantially all of the display surface preferably extends above the tabletop surface. Conversely, when the planar member is in the retracted position, substantially all of the display surface extends below the tabletop surface.

In a feature of this aspect, the workstation further includes a handle for facilitating movement of the planar member between the protracted position and the retracted position. The handle is connected to, or formed as part of, the planar member and extends above the surface of the tabletop for moving of the planar member by a user.

In another feature of this aspect, the planar member pivots about a pivot axis between the protracted position and the retracted position. Preferably, the pivot axis is orthogonally disposed to the plane of the planar member.

In another feature of this aspect, the tabletop defines a slot through which the planar member moves when moving between the protracted position and the retracted position. In still yet another feature of this aspect, the tabletop comprises a smooth writing surface. More particularly, the tabletop preferably includes a perimeter having a surface that is substantially planar such that no raised edge extends about the perimeter of the tabletop. Further, the tabletop preferably includes an indentation formed therein for receiving and retaining a writing instrument.

In another feature of this aspect, the tabletop is readily detachable from the chassis of the workstation and, thereby, may be readily substituted with another, different tabletop. The other tabletop may include, for example, a different configuration of indentations therein, or may include varied work surfaces. The tabletop further may be substituted with a like tabletop if the tabletop is in need of replacement or repair. In a preferred embodiment of this feature, one or more tabletops, or portions thereof, are formed from one or more molding processes, such as injection molding, blow molding, or rotational molding processes.

In another feature of this aspect, the portable workstation further includes a drawer supported by the chassis and moveable between (i) an open position, wherein access is provided to the interior of the drawer and contents contained therein for removal, and (ii) a closed position, wherein access to the interior of the drawer is inhibited, and wherein the planar member, when in the retracted position, secures the drawer from moving from the closed position to the open position. In accordance with this feature, the drawer is disposed on a side of the workstation and constitutes a side drawer of the workstation.

In yet another feature of this aspect, the portable workstation further includes a lock movable between a locked position, wherein the planar member is inhibited from moving from the retracted position to the protracted position, and an unlocked position, wherein the planar member is allowed to move from the retracted position to the protracted position. Preferably, the lock includes a combination lock.

In an additional feature of this aspect, the portable workstation includes a biasing member that biases the planar member in a direction from the retracted position toward the protracted position. In accordance with this feature, the biasing member includes a spring-like cylinder. Preferably, the spring-like cylinder comprises an air cylinder. In another preferred embodiment of this feature, the spring-like cylinder is mounted to the chassis for pivotable movement relative thereto and is mounted to the planar member for pivotable movement relative thereto.

In accordance with this feature, the portable workstation includes a catch that secures the planar member in the retracted position against automatic movement of the planar member from the retracted position toward the protracted position as a result of the biasing member. Preferably, the catch includes a magnetic catch, and the planar member includes a portion that is attracted to the magnetic catch.

In a feature of this aspect, the portable workstation includes drawers. In a preferred embodiment of this feature, the drawers are disposed on one side of the workstation and at an end of the workstation. In another preferred embodiment of this feature, the drawers are disposed on one side of the workstation and at opposite ends of the workstation. Preferably, at least one of the drawers includes channels for receiving hanging files therein. In further accordance with this feature, one of the drawers is insulated.

In another feature of this aspect, the workstation includes a brake biased into abutting engagement with one of the wheels, the brake inhibiting movement of the wheel. In accordance with this feature, the workstation includes a hand brake that controls engagement of the brake with the wheel. Preferably, the hand brake causes the brake to disengage from the wheel when the hand brake is actuated by hand. More preferably, the workstation includes a handle for pushing and pulling the workstation and the hand brake is mounted to the handle.

In yet another feature of this aspect, the workstation includes a handle for imparting movement to the workstation, the handle being mounted to the chassis in pivotable disposition relative to the chassis, whereby persons of varying heights using the portable workstation may be accommodated.

In an additional feature of this aspect, the wheels include a pair of back wheels and a pair of front wheels. Preferably, the back wheels are mounted to the chassis in pivotable disposition relative to the chassis, and the front wheels may be mounted in non-pivotable disposition relative to the chassis.

In a further feature of this aspect, the workstation includes a housing connected to the chassis and electrical outlets disposed in a surface of the housing. Preferably, the workstation includes a power cord connected to the outlets for supplying electric current, the power cord including a length sufficient for plugging into an electrical outlet of a building in which the workstation is disposed.

In another feature of this aspect, the chassis includes a three-dimensional support frame. Preferably, the support frame defines a shelving structure upon which a drawer is received and supported. It is preferred that the drawer be disposed in sliding engagement with the support frame, the drawer being removable from the support frame when the planar member is in the protracted position.

In an additional aspect of the invention, a portable workstation in accordance with the aforementioned construction further includes a design in which the workstation includes a first and a second generally planar member that are joined to the wheels and the tabletop by the chassis. In this aspect, the first planar member is movable between (i) a first planar member protracted position, wherein a majority of the first planar member extends above the tabletop, and (ii) a first planar member retracted position, wherein a majority of the first planar member does not extend above the tabletop. Further, the second planar member is movable between (i) a second planar member protracted position, wherein a majority of the second planar member extends above the tabletop, and (ii) a second planar member retracted position, wherein a majority of the second planar member does not extend above the tabletop.

In a feature of this aspect, the first planar member pivots between the first planar member protracted position and the first planar member retracted position, and the second planar member pivots between the second planar member protracted position and the second planar member retracted position.

In another feature of this aspect, the first planar member pivots in a first rotational direction in moving from the first planar member retracted position toward the first planar member protracted position, and the second planar member pivots in a second rotational direction, opposite to the first rotational direction, in moving from the second planar member retracted position toward the second planar member protracted position.

In yet another feature of this aspect, the tabletop defines a first slot through which the first planar member moves and a second slot through which the second planar member moves. Preferably, the first slot is parallel to the second slot.

In another aspect of the invention, a portable workstation comprises wheels for movement of the workstation; a tabletop providing a work surface of the workstation; a chassis joining said wheels and said tabletop; and a plurality of drawers, wherein one of said drawers is adapted to receive hanging files.

In a feature of this aspect, the portable workstation is configured to support a said drawer adapted to receive hanging files when said drawer is substantially extended. In another feature, the portable workstation includes side telescoping rails that support a said drawer adapted to receive hanging files when said drawer is substantially extended. It is preferred that said drawer is disposed at an end of the workstation.

In an additional aspect of the invention, a portable workstation comprises wheels for movement of the workstation; a tabletop providing a work surface of the workstation; a chassis joining said wheels and said tabletop; and a self-sufficient sink assembly located within said chassis, said sink assembly including a sink located within said tabletop, a reservoir for storage of clean water, a reservoir for storage of dirty water, a water pump, a faucet, and fluid conduits operatively connecting said sink, said reservoirs, said water pump, and said faucet.

In another aspect of the present invention, a method of using a portable workstation having a self-sufficient sink assembly in a satellite classroom, wherein the satellite classroom does not include access to running water, comprises the steps of providing a portable workstation having a self-sufficient sink assembly in the satellite classroom and using the sink of the portable workstation in connection with teaching in the satellite classroom. The sink assembly includes a sink located within a tabletop of the portable workstation, a first reservoir located within the portable workstation for storage of clean water, a second reservoir located within the portable workstation for storage of dirty water, a water pump located within the portable workstation, a faucet disposed adjacent the sink, and fluid conduits operatively connecting said sink with said reservoirs, said water pump, and said faucet for water flow from the first reservoir, through the faucet, into the sink, and to the second reservoir; and using In a feature of this aspect, the satellite classroom comprises a mobile trailer. In accordance with this feature, the sink of the portable workstation is utilized in connection with teaching a science class.

In addition to the aforementioned aspects and features of the present invention, it should be noted that the present invention further includes the various possible combinations of such aspects and features.

V. BRIEF DESCRIPTION OF THE DRAWINGS

Further aspects, features, embodiments, and advantages of the present invention will become apparent from the following detailed description with reference to the drawings, wherein.

VI. DETAILED DESCRIPTION

Figure 1:
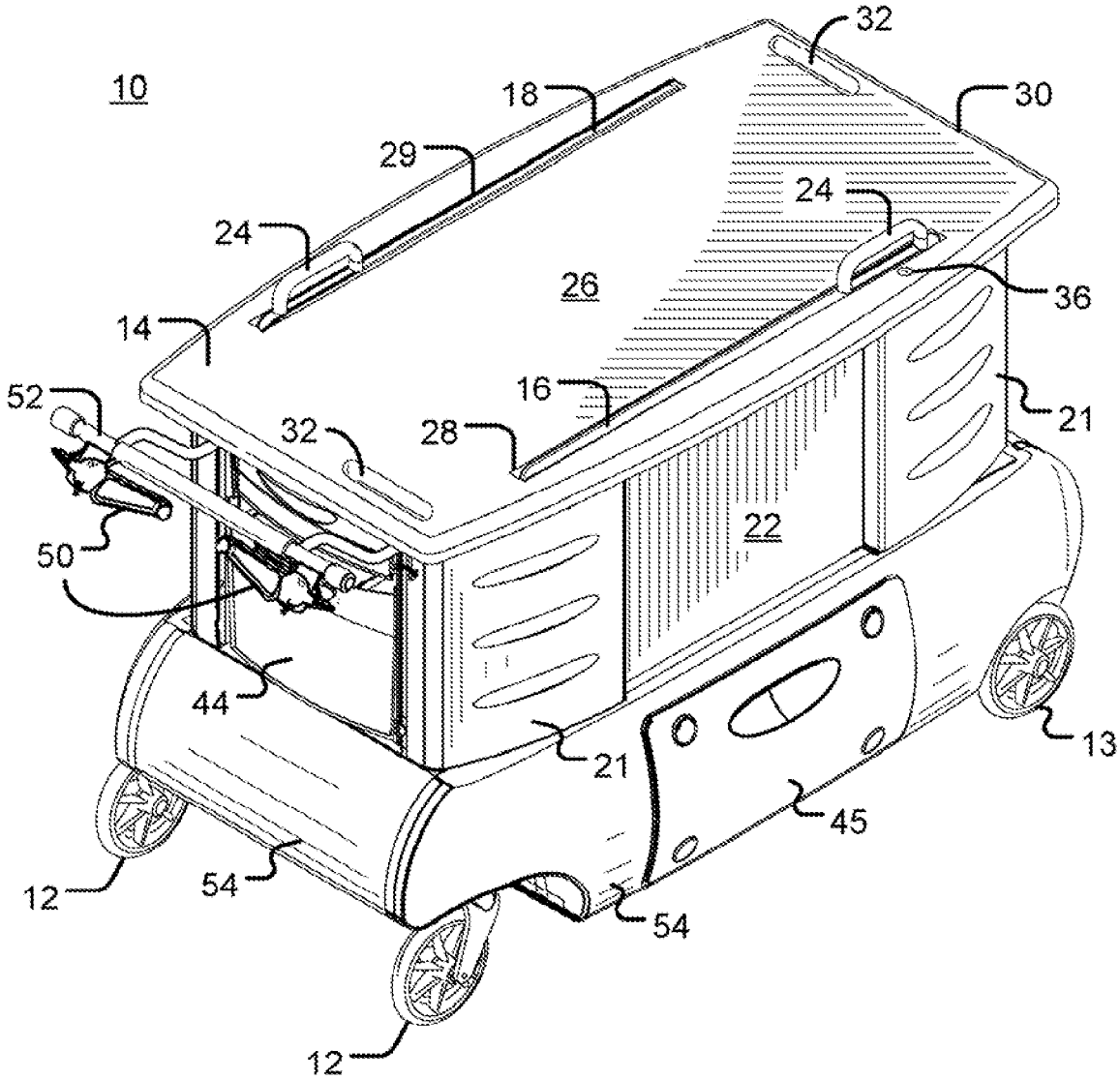
FIG. 1 is a side perspective view of the workstation in accordance with an embodiment of the present invention, wherein first and second planar members are disposed in retracted positions.

As a preliminary matter, and for purposes of claim construction in the United States, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more workstations in accordance with one or more preferred embodiments of the present invention are next described.

Figure 2:
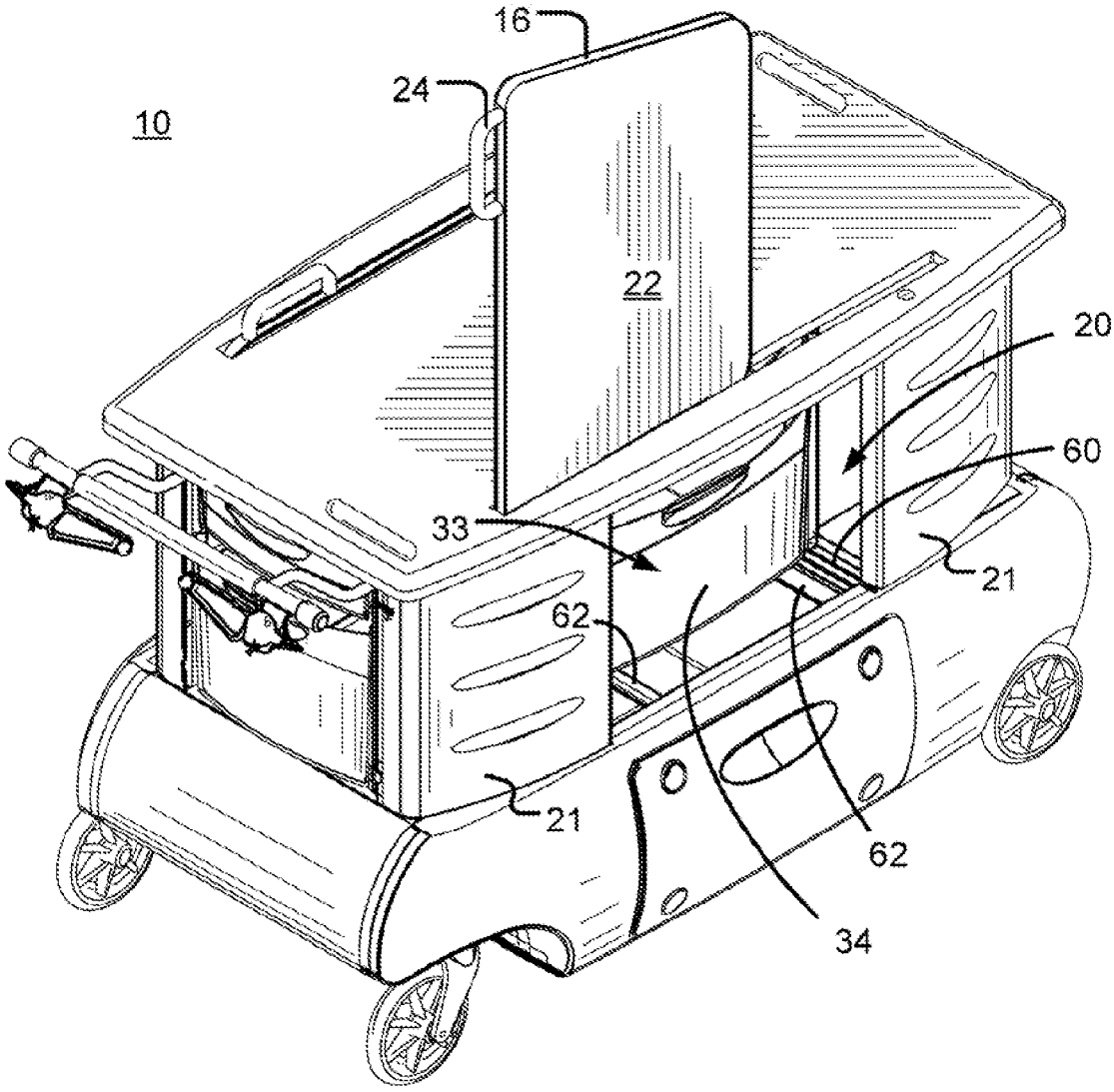
FIG. 2 is another side perspective view of the workstation of FIG. 1, wherein a first planar member is disposed in a protracted position.

FIG. 1 and FIG. 2 are side perspective views of the workstation 10 in accordance with an embodiment of the present invention. The workstation 10 has a generally box-like configuration and comprises a pair of back wheels 12, a pair of front wheels 13, a tabletop 14, a first planar member 16, a second planar member 18, and a chassis 20 that connects together the wheels 12,13, the tabletop 14, and the planar members 16,18. The chassis 20 includes a three-dimensional support frame 60. The workstation 10 further includes a plurality of drawers, including side drawers 34, a lower side drawer 45 disposed below the other side drawers 34, and four end drawers 44, two at each end, for storing teaching supplies, as well as a plurality of aesthetic, molded body panels 21 for enhancing the appearance of the workstation 10 by enclosing the chassis 20. In addition, the workstation 10 includes a lower housing 54 connected to the chassis 20 with electrical outlets 56 (shown in FIG. 9) disposed in a surface thereof.

The workstation 10 further includes a handle 52 for the pushing and pulling of the workstation 10 by a user. Although not specifically illustrated, the handle 52 is mounted to the chassis 20, in a pivotable disposition relative to the chassis 20, whereby persons of varying heights using the workstation 10 may be accommodated. At least one and preferably two hand brakes 50 are mounted to the handle 52 and are operatively connected to at least one of the wheels 12 for inhibiting movement of the workstation 10.

The workstation 10 has four wheels 12,13 mounted to the chassis 20, the first pair disposed near the corners at one end of the workstation 10, hereinafter the back wheels 12, and the second pair disposed near the corners at the opposite end of the workstation 10, hereinafter the front wheels 13. Each of the back wheels 12 is mounted to the chassis 20 by a pivotable connection that enables the back wheel 12 to pivot at its respective mounting relative to the chassis 20. The front wheels 13 are mounted to the chassis 20 with a conventional wheel axle and, thus, do not pivot at their mountings relative to the chassis 20. Such a mounting arrangement, with selective wheel pivoting, enables the workstation 10 to be easily moved and maneuvered by a user holding the handle 52.

The tabletop 14 is generally rectangular, having opposed ends, opposed sides and a generally planar surface that provides a work surface 26 for a person using the workstation 10. As a part of the work surface 26, the tabletop 14 includes a writing surface for the user. The perimeter 30 of the tabletop 14 is substantially planar such that no raised edge extends upwardly about the perimeter 30. The tabletop 14 includes a first slot 28 and a second slot 29 through which the planar members 16,18 move, respectively. The first slot 28 is preferably parallel to the second slot 29. The tabletop 14 also includes indentations 32 for receiving and retaining writing utensils and the like. The indentations 32 have an elongate configuration and are designed for receiving and retaining writing instruments, such as those for use with the display surfaces 22 of the planar members 16,18.

It is preferred that the tabletop 14 be removably joined to the chassis 20 so that the tabletop 14 may be replaced with a different tabletop 14, as desired. In this respect, it is contemplated that different tabletops may be provided, each having a different configuration of indentations, works surfaces, etc., and that one tabletop may be readily substituted for another tabletop as desired. For example, a tabletop incorporating a sink with self-sufficient running water may be utilized. In addition, a molded tabletop configured to accommodate various audio-visual equipment and/or a printer may also be utilized.

Figure 10:
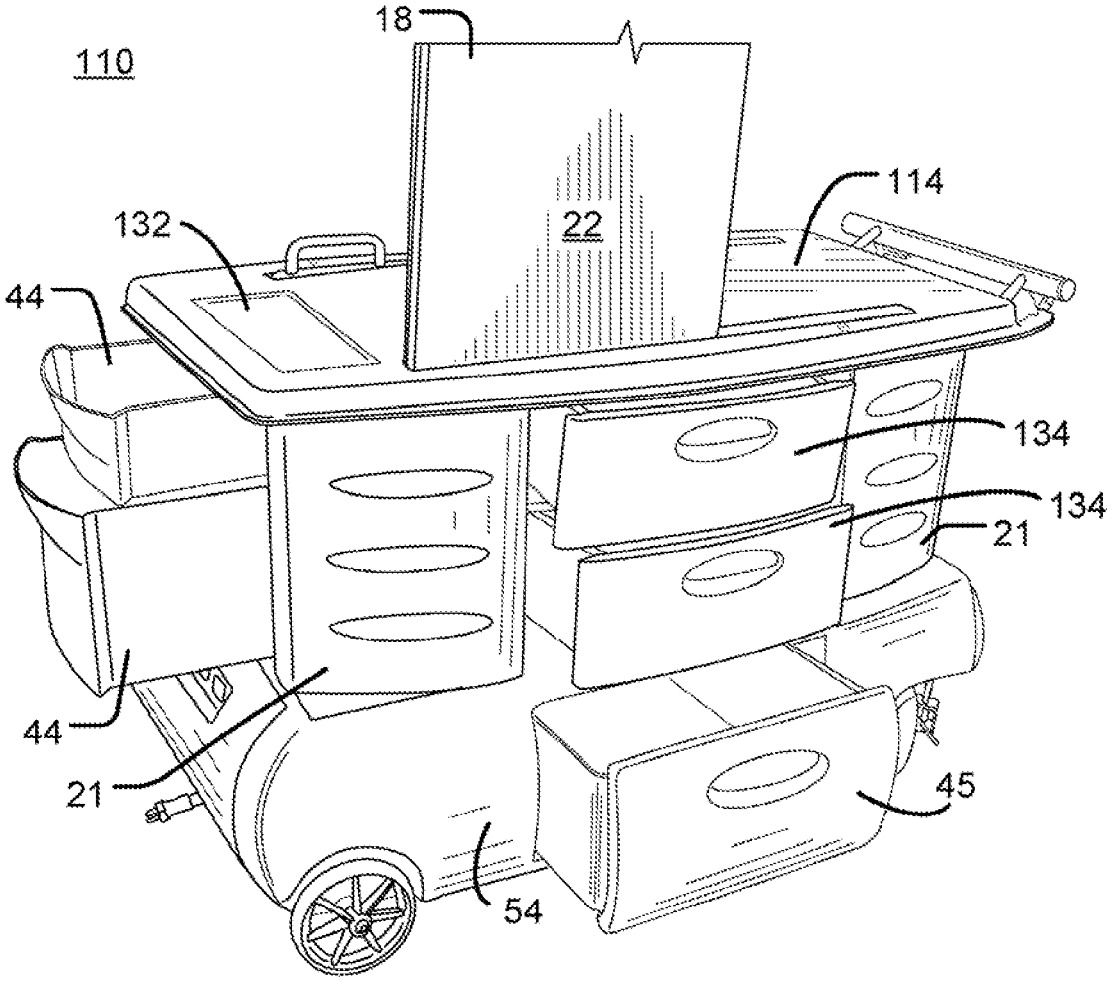
FIG. 10 is a side perspective view of another workstation similar to that of FIG. 1 showing drawers of the alternative workstation in open positions.

A tabletop 114 having a different indentation configuration is shown in FIG. 10, wherein indentation 132 in tabletop 114 of workstation 110 has a rectangular perimeter and greater area than the indentations 32 in the tabletop 14 of the workstation 10 of FIG. 1. Moreover, a damaged tabletop 14 also may be readily replaced with a new tabletop having the same configuration. It is also preferred that the tabletop 14 and substitute tabletops be formed from one or more molding processes, such as injection molded, blow molded, and rotational molded processes.

Figure 12:
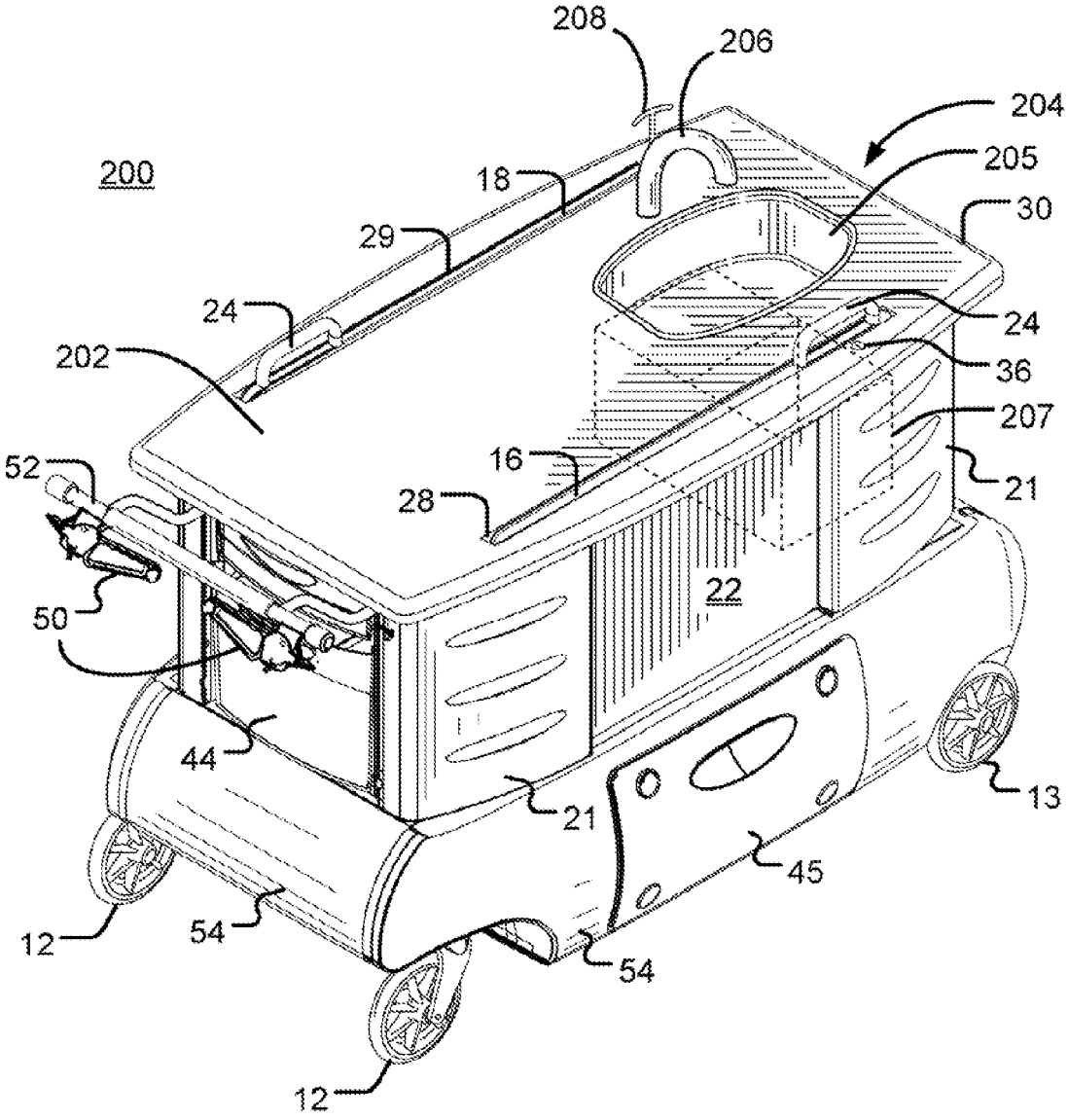
FIG. 12 is a side perspective view of a teacher workstation in accordance with an alternative embodiment, wherein the tabletop includes a self-sufficient sink.

FIG. 12 is a perspective view of a teacher workstation 200 in accordance with an alternative embodiment, wherein the tabletop 202 includes a sink assembly 204 with self-sufficient running water. The sink assembly 204 comprises a sink 205, a split-cavity water reservoir 207, a faucet 206, a water pump (not shown), a water pump handle 208 and tubing operatively connecting the components of the sink assembly 204. The split-cavity water reservoir 207 is disposed within the workstation housing for storing clean water prior to its use in the sink 205 and dirty water after it has been used in the sink 205. The water reservoir is disposed behind one of the aesthetic panels of the workstation 200. The faucet 206 extends perpendicularly from the tabletop 202 surface and is configured to deposit water into the sink 204. The water pump is disposed within the workstation 200 housing and is operatively connected to the water pump handle 208. The water pump handle 208 extends through an opening in the rise of the faucet 206. A drain (not shown) is disposed in a base of the sink 205 for removing water from the sink 205. The water pump is operatively connected to the clean water reservoir and the faucet 206 for depositing clean water into the sink 205 when the water pump handle 208 is actuated. The drain is operatively connected to the dirty water reservoir in order to remove and store water that has been used in the sink 205. In order to obtain running water, a user simply operates the water pump handle 208 to cause water to flow into the sink 205. Such water then drains out of the sink 205 into the dirty water reservoir. In order to prepare the workstation 200 for use, a user may fill the clean water reservoir with clean water and remove any previously used dirty water from the dirty water reservoir. In an exemplary embodiment, the sink 205 holds approximately three gallons of water, and the clean and dirty water reservoirs each hold approximately three and a half gallons of water for a total of seven gallons of capacity in the reservoirs.

Figure 13:
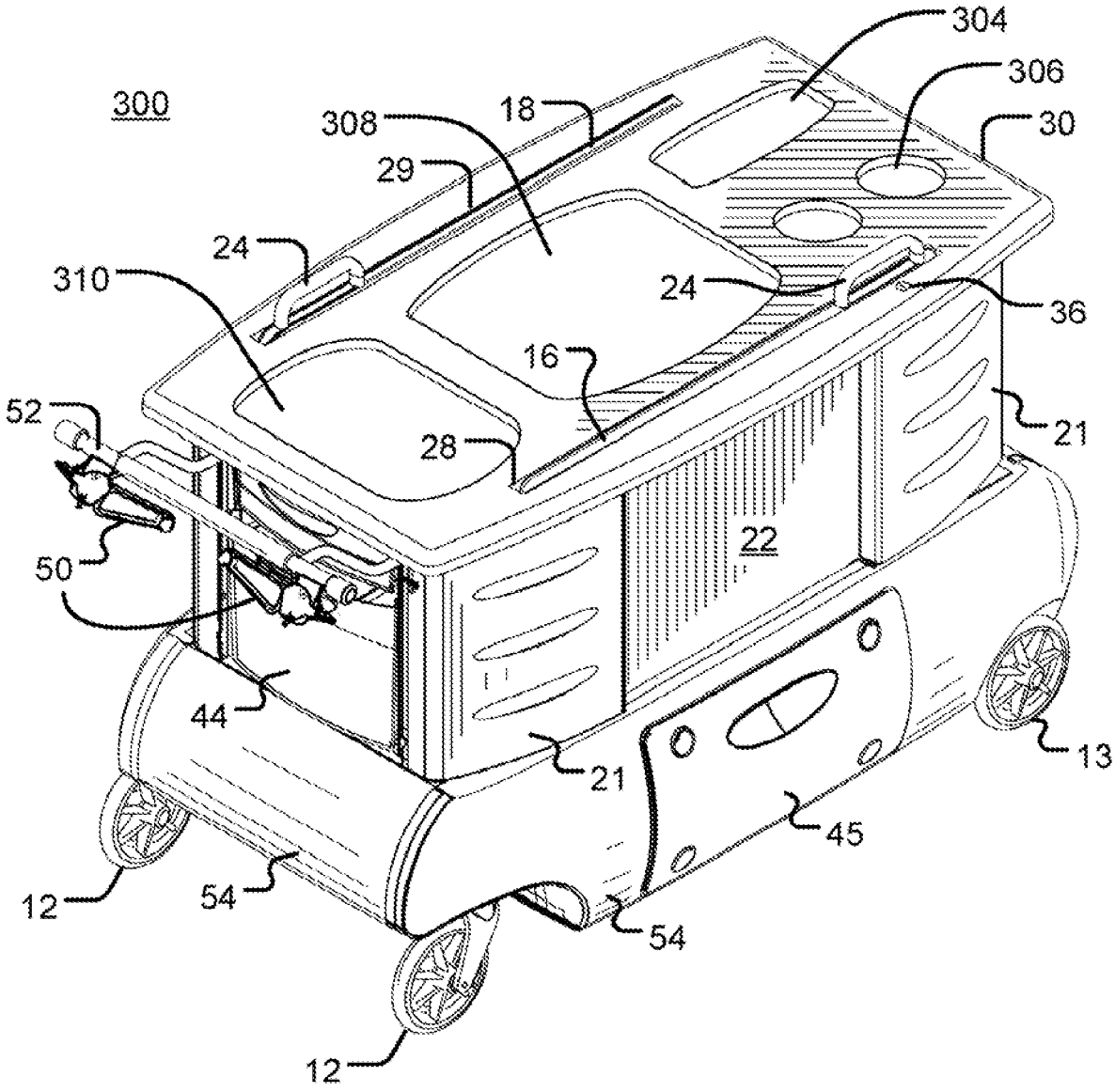
FIG. 13 is a side perspective view of a teacher workstation in accordance with yet another alternative embodiment, wherein the tabletop includes a molded tabletop configured to accommodate various instructional equipment.

FIG. 13 is a perspective view of a teacher workstation 300 in accordance with yet another alternative embodiment, wherein the tabletop includes a molded tabletop configured to accommodate various equipment, such as audio-visual equipment, a printer and the like. An exemplary tabletop configuration may include recessed areas 304, 306, 308, 310 for retaining a projector, a laptop, a printer, cups, jars, writing or drawing utensils and the like In FIG. 2, the first planar member 16 is shown in a protracted position, while in FIG. 3, which is another side perspective view of the workstation 10, both the first planar member 16 and the second planar member 18 are disposed in protracted positions. The structure and movement of both planar members 16,18 is preferably the same; thus, for illustrative purposes, only the first planar member 16 will be described next.

The first planar member 16 is connected to the chassis 20 by a pivot member (not shown) such that the first planar member 16 is configured to pivot about a pivot axis between a protracted position, wherein a majority of the first planar member 16 extends above the tabletop 14, and a retracted position, wherein a majority of the first planar member 16 does not extend above the tabletop 14.

In particular, the first planar member 16 includes a display surface 22 such that, when in the protracted position, substantially all of the display surface 22 preferably extends above the work surface 26 of the tabletop 14. Conversely, when the planar member 16 is in the retracted position, substantially all of the display surface 22 extends below the tabletop surface 26. The display surface 22 may be a dry erase board, a chalk board, a corkboard, or any of various other display surfaces, or a combination thereof, that facilitate instruction. Having a display surface 22 that is self-contained within the workstation 10 is ideal for a teacher that moves from classroom to classroom, because the teacher will not have to make any special arrangements for displaying information when he or she changes classrooms.

The pivot axis of the planar member 16 is orthogonally disposed in relation to the plane of the planar member 16 such that when the planar member 16 is in the protracted position, it may be used to display information to students. The first planar member 16 moves through the first slot 28 when moving between the protracted position and retracted position. In like manner, the second planar member 18 moves through the second slot 29 when moving between the protracted position and retracted position.

To facilitate movement of the planar members 16,18 through the first and second slots 28,29, the workstation 10 includes a handle 24 disposed on the each planar member 16,18. In particular, the handles 24 are disposed such that they will protrude through the first and second slots 28,29 in the tabletop 14 when the planar members 16,18 are in their respective retracted positions so that the handles 24 will be easily accessible by a user.

A user may selectively use a single planar member 16,18 or may utilize both planar members 16,18 at the same time.

Referring particularly to FIG. 2, when the first planar members 16 is in its protracted position, an opening 33 is created between aesthetic body panels 21 of the workstation 10 that allows the side drawers 34, otherwise enclosed by and completely contained within the workstation 10, to be accessed for removal of contents contained therein. These side drawers 34 are not otherwise accessible when the first planar member 16 is in the retracted position because the planar member 16 completely covers the side drawers 34 to enclose the drawers 34 within the workstation 10.

The side drawers 34 are supported by a shelving structure 62 that is defined by the three-dimensional support frame 60. More particularly, the drawers 34 are disposed in sliding engagement with the support frame 60 such that the drawers 34 are removable from the support frame 60 when the first planar member 16 is in the protracted position. The side drawers 34 thus also serve as portable containers that are usable separate from the workstation 10.

Figure 3:
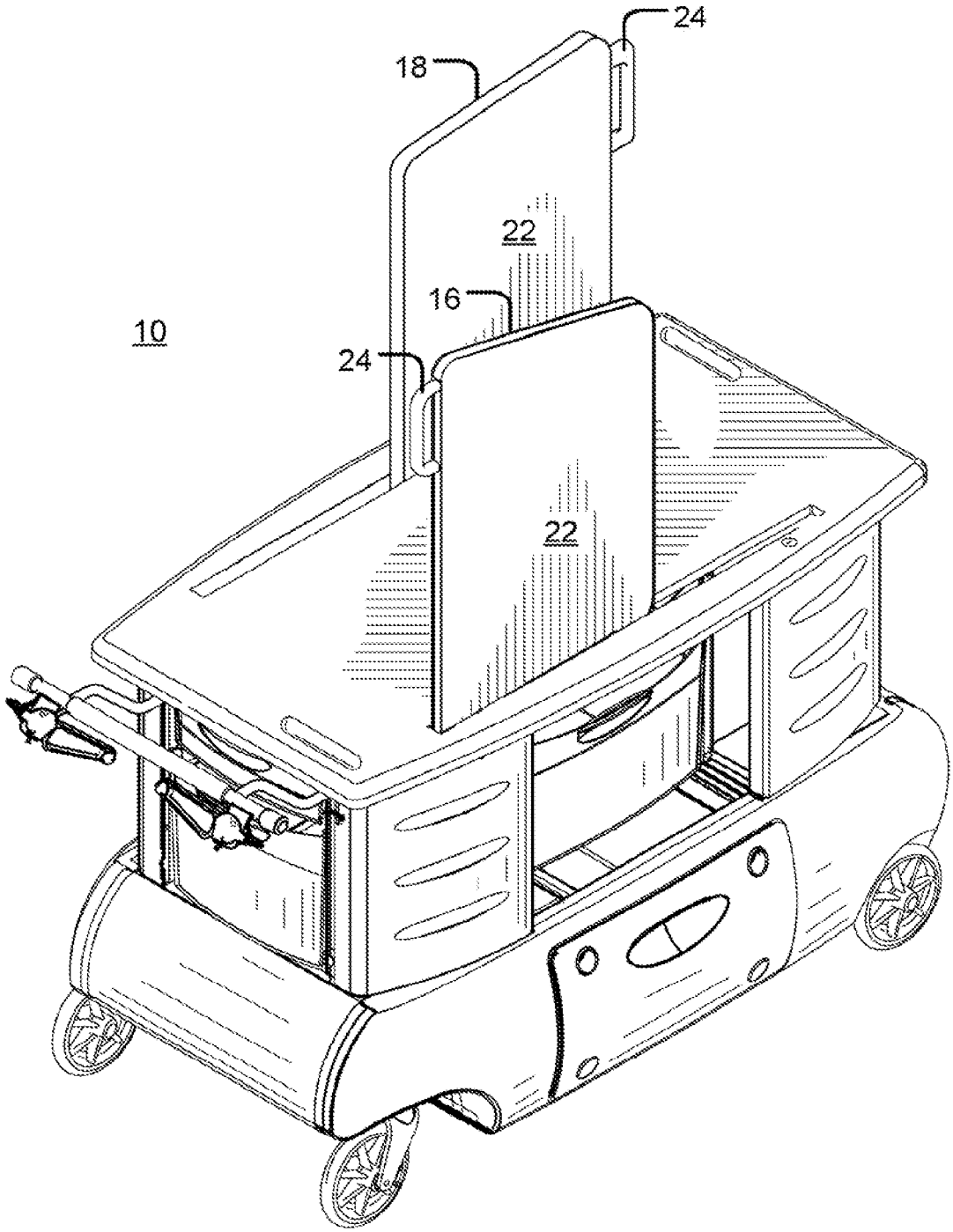
FIG. 3 is another side perspective view of the workstation of FIG. 1, wherein first and second planar members are disposed in protracted positions.

In the workstation 10 illustrated in FIG. 2 and FIG. 3, the side drawers 34 open to one side and an interior panel (not shown), fixedly connected to the chassis 20, precludes access to the interior of the workstation 10 when the second planar member 18 is moved out of its retracted position. Further in this regard, each side drawer 34 preferably extends a substantial portion of the width of the workstation 10.

In an alternative construction to the workstation 10 of FIG. 2 and FIG. 3, which is represented in workstation 110 of FIG. 10, each side drawer 134 on the right hand side only extends a substantial portion of half of the width of the workstation 110, and additional side drawers 134 are included on the other (left hand) side of the workstation 110 that are similarly accessible when the second planar member 18 is moved into in its protracted position. In this alternative construction, an interior panel (not shown) preferably is connected to the chassis 20 along a center of the workstation 110 such that access is precluded from one side of the workstation 110 to the side drawers 134 on the other side.

Figure 4:
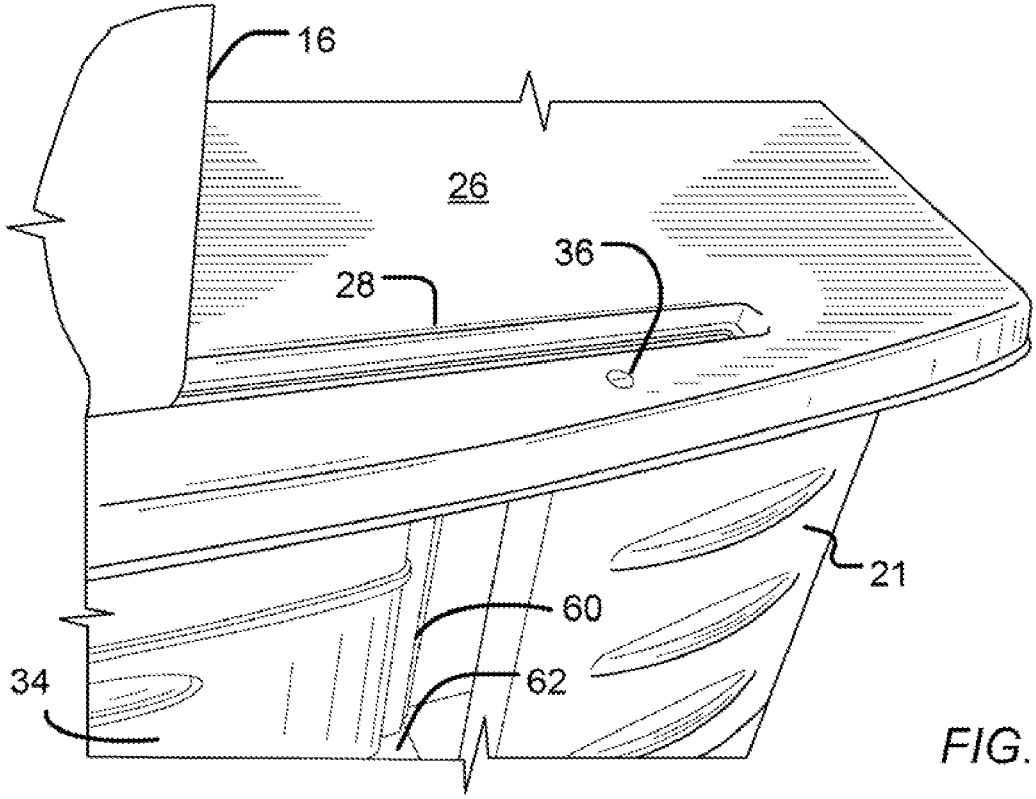
FIG. 4 is a detailed, cutaway view of the workstation of FIG. 2 showing a first slot in the tabletop through which the first planar member extends.

FIG. 4 is an enlarged, cutaway view of the workstation 10 of FIG. 2 showing the first slot 28 in the tabletop 14 through which the first planar member 16 extends. A lock 36 is provided to inhibit movement of the first planar member 16 between its protracted and the retracted positions. In particular, a bolt or tongue of the lock 36 preferably extends transversely across the slot 28 to block the first planar member 16 from moving through the slot when the lock 36 is in the locked position. The bolt or tongue preferably does not extend transversely across the slot when the lock 36 is in the unlocked position. Any type of lock may be used, e.g., a keyed lock or a combination lock. Exemplary locks are disclosed in U.S. Pat. No. 4,168,103 (key lock with locking tongue) and U.S. Pat. No. 4,761,978 (key lock with locking bolt), each of which is hereby incorporated herein by reference. An exemplary combination lock with locking bolt is disclosed in U.S. Pat. No. 4,366,687, which is hereby incorporated herein by reference.

A keyed lock 36 is illustrated in the workstation 10 of the drawings. In particular, the keyed lock 36 is shown disposed within the tabletop 14 near an end of the first slot 28 proximate the handle 24 of the first planar member 16. As such, a user may easily unlock the first planar member 16 and raise it to its protracted position and easily lock the planar member 16 when it is in its retracted position. Moreover, when the first planar member 16 is locked in its retracted position, the side drawers 34 contained within the workstation 10 are blocked and thereby secured by the locked first planar member 16.

It will also be appreciated from the foregoing description that, in an alternative construction of the workstation 110 in which additional side drawers 134 are disposed on the other side of the workstation 110, as shown, for example, in FIG. 10, an additional lock 36 may be provided in the tabletop 14 for locking the planar member 18 in its retracted position to thereby secure the additional side drawers 134.

Figure 5:
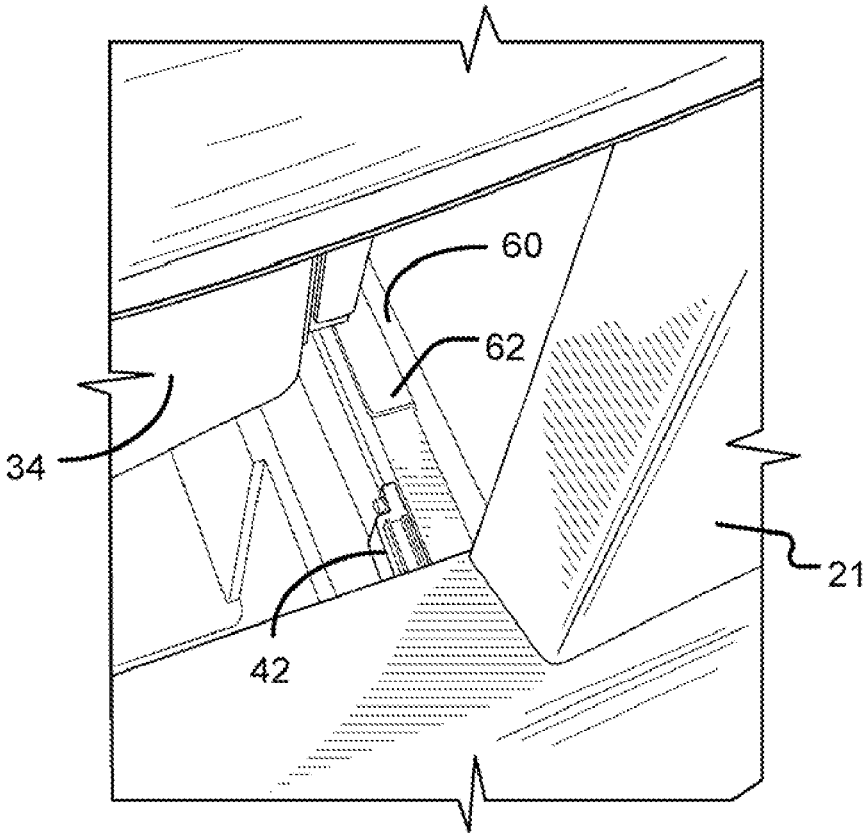
FIG. 5 is a detailed, cutaway view of the workstation of FIG. 2 showing a portion of the interior of the workstation that is exposed when the first planar member is in a protracted position.

FIG. 5 is another enlarged, cutaway view of the workstation 10 showing a portion of the interior of the workstation 10 that is exposed when the first planar member 16 is in its protracted position. In particular, a magnetic catch 42 is mounted to the support frame 60. Correspondingly, a metal member (not shown) is disposed on a portion of the bottom edge of the first planar member 16 such that when the first planar member 16 is in its retracted position, the associated magnetic catch 42 secures the planar member 16 against accidental movement from the retracted position to the protracted position. However, when the handle 24 of the first planar member 16 is pulled by a user, the magnetic catch 42 releases to allow the planar member 16 to move from the retracted position to the protracted position. The second planar member 18 also includes a metal member disposed thereon for securing the second planar member 18 to a similar magnetic catch mounted to the chassis 20 on the other side of the workstation 10.

Figure 6:
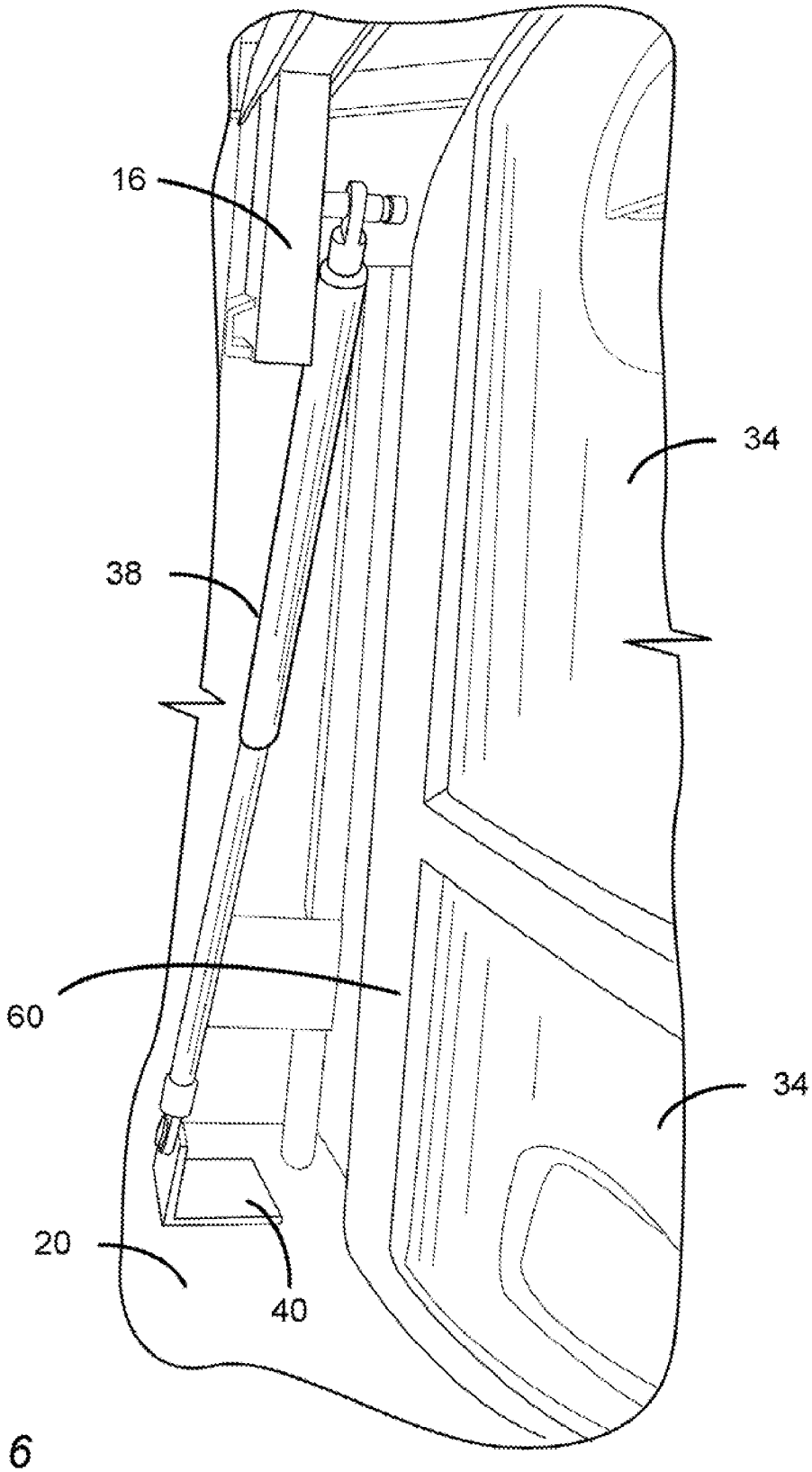
FIG. 6 is a detailed, cutaway view of the workstation of FIG. 2 showing a biasing member urging the first planar member toward, and maintaining the first planar member in, a protracted position as shown in FIG. 2.

FIG. 6 is a detailed, interior cutaway view of the workstation 10 showing a biasing member 38 urging the first planar member 16 toward, and maintaining the first planar member 16 in, a protracted position. In particular, the biasing member 38 is mounted to the chassis 20 and to the first planar member 16 for biasing such planar member 16 in a direction from the retracted position toward the protracted position.

The biasing member 38 is mounted to the chassis 20 by a bracket 40. The bracket 40 is fixedly mounted to the chassis 20, and the biasing member 38 is mounted to the bracket 40 for pivotable movement relative thereto. Similarly, the biasing member 38 is mounted to the planar member 16 for pivotable movement relative thereto. When a user pulls the handle 24 of the planar member 16, the biasing member 38 allows the planar member 16 to rise slowly and in a controlled fashion from the retracted position to the protracted position.

It is preferred that the biasing member 38 comprise a spring-like cylinder 41, i.e., a cylinder that exhibits elastic characteristics similar to those exhibited by a spring. It is further preferred that the spring-like cylinder comprise a "pneumatic" or an "air" cylinder.

As with the other structures associated with the planar members 16,18 described herein, the workstation 10 also includes a similar biasing member on the other side of the workstation 10 that is mounted to the chassis 20 and to the second planar member 18 for urging the second planar member toward, and maintaining the second planar member 18 in, a protracted position.

Figure 7:
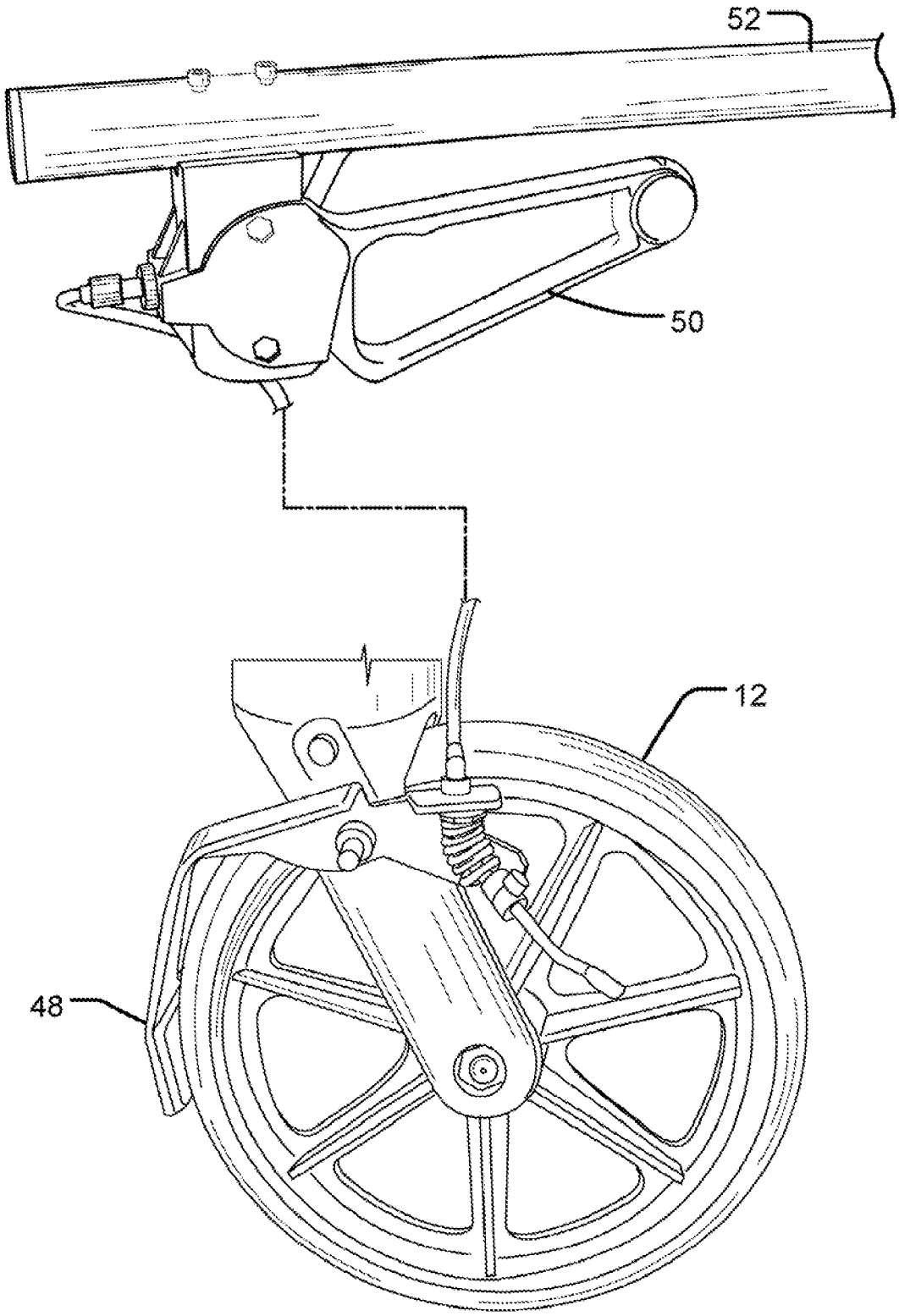
FIG. 7 is a detailed side perspective view of one of the hand brakes and one of the wheels of the workstation of FIG. 1.

FIG. 7 is a detailed side perspective view of one of the hand brakes 50 and one of the wheels 12 of the workstation 10. A brake 48 is disposed on the wheel 12 and is normally biased into abutting engagement therewith. The brake 48 inhibits movement of the wheel 12 when it is engaged. A hand brake 50 is operatively connected to the brake 48 to control engagement of the brake 48 with the wheel 12. Because the hand brake 50 is mounted on the handle 52, the hand brake 50 provides a user with easy access to the brake 48.

Figure 8:
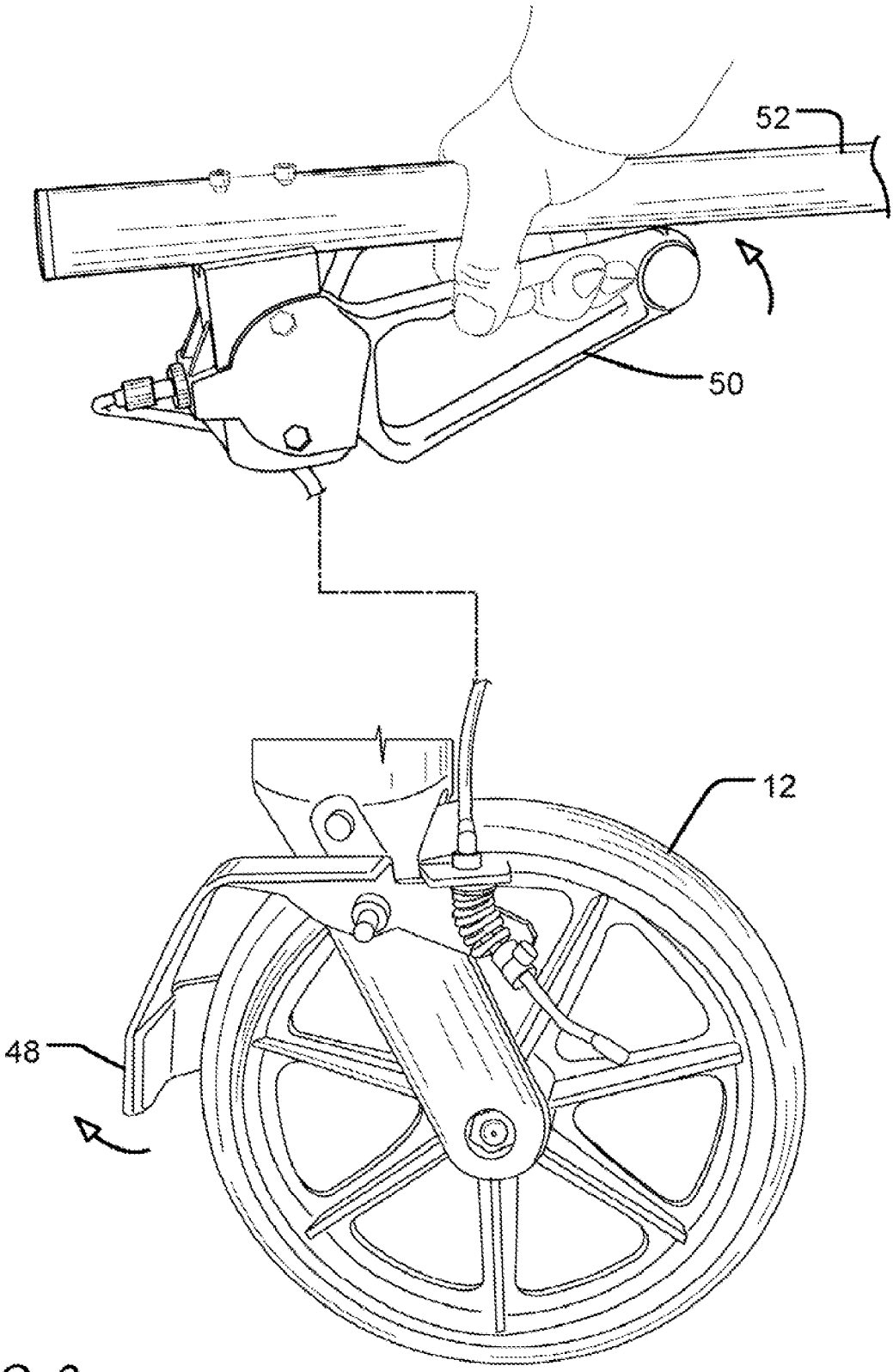
FIG. 8 is an illustration of a user actuating the hand brake of FIG. 7, thereby releasing the brake for rotational movement of the wheel.

FIG. 8 is an illustration of a user actuating the hand brake 50 of FIG. 7, thereby releasing the brake 48 for rotational movement of the wheel 12. Specifically, when a user actuates the hand brake 50 by pulling it toward the handle 52 with his or her hand, the hand brake 50 causes the brake 48 to disengage from the wheel 12 as shown by the arrows in FIG. 8. Accordingly, in order to move the workstation 10, a user grasps the handle 52, pulls the hand brake 50, thereby disengaging the brake 48, and begins pushing or pulling the workstation 10. The illustrated workstation 10 includes two hand brakes 50 disposed on the handle 52 and a respective brake 48 disposed on each one of the rear wheels 12. However, the workstation 10 alternatively may have a single hand brake for controlling and a plurality of brakes disposed on a plurality of wheels.

Figure 9:
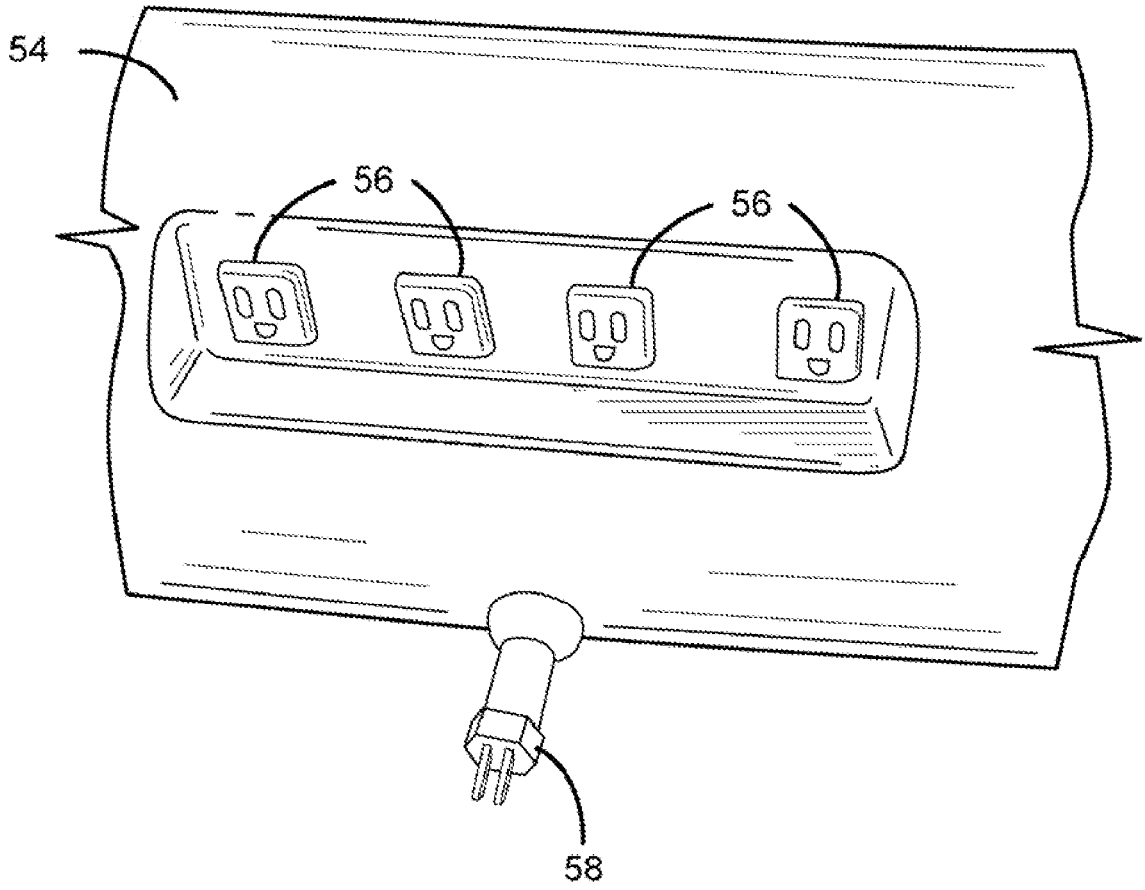
FIG. 9 is a detailed perspective view of electrical outlets of the lower housing of the workstation of FIG. 1.
Figure 11A:
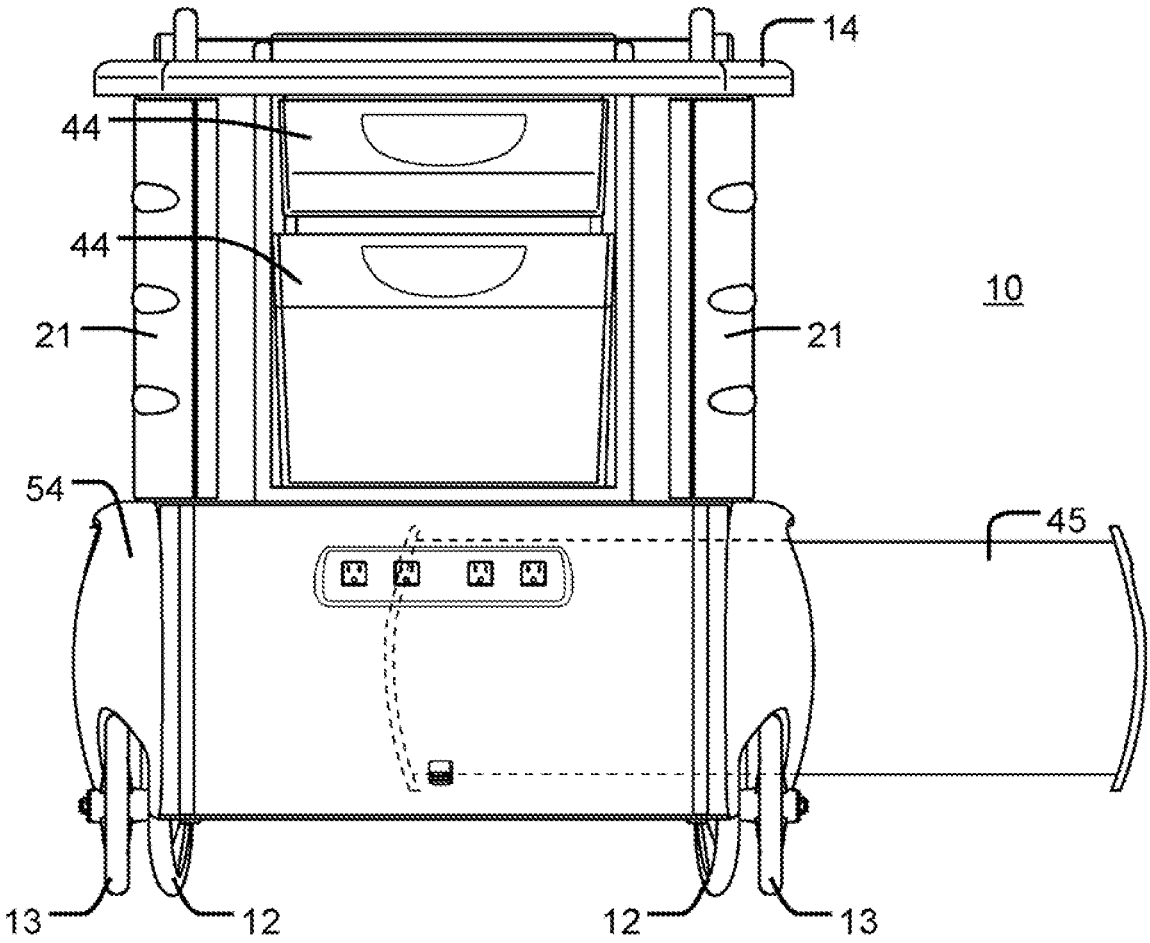
FIG. 11A and FIG. 11B are front end views of the workstation of FIG. 1 showing the pass-through capability of the lower side drawer.
Figure 11B:
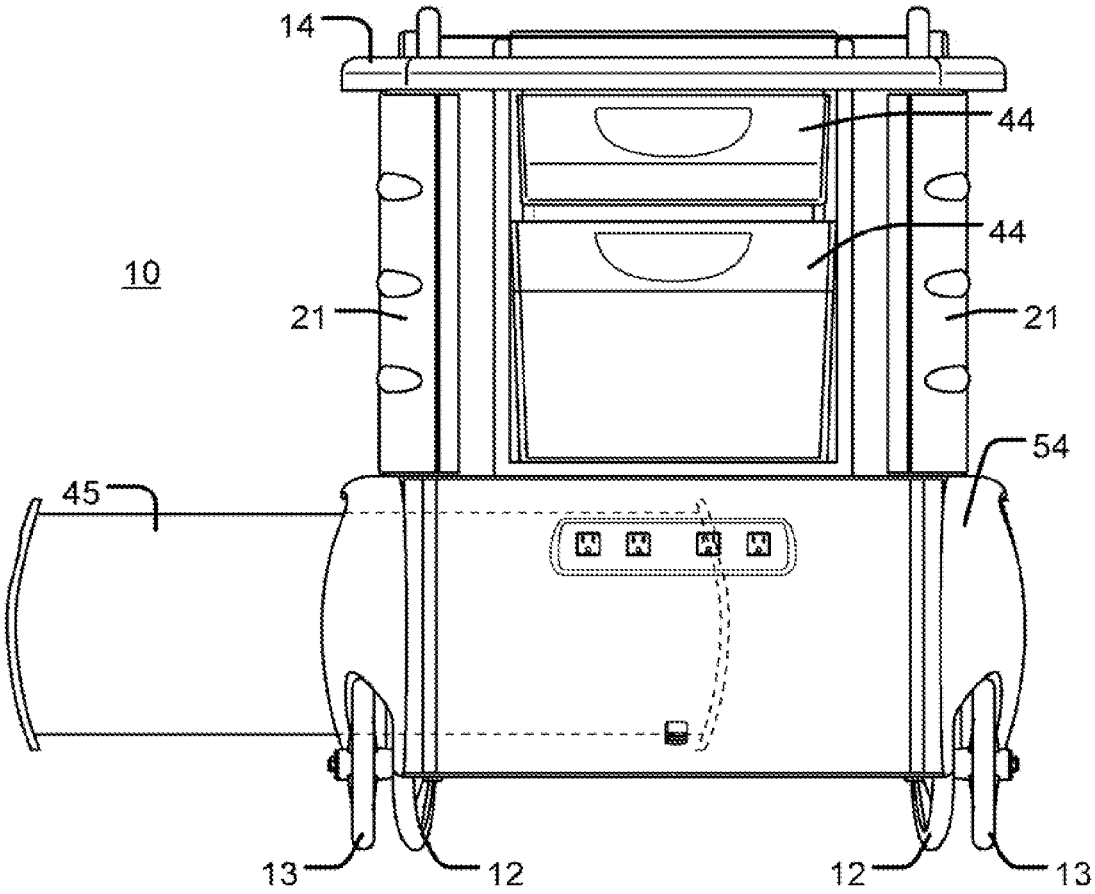

FIG. 9 is a detailed perspective view of the electrical outlets 56 of the lower housing 54 of the workstation 10. As best seen in FIG. 10, FIG. 11A and FIG. 11B, the electrical outlets 56 are disposed at the front end of the workstation 10, the front end being the end of the workstation opposite the rear end, to which the handle 52 is mounted. Because the workstation 10 preferably does not include a power source, a power cord 58 is electrically connected to the electrical outlets 56 for supplying electrical current thereto. The power cord 58 is preferably retractable and includes a length sufficient for plugging into an electrical outlet of a building in which the workstation 10 is disposed.

FIG. 10 is a side perspective view of another workstation 110 similar to that of FIG. 1 showing side drawers 134 and end drawers 44 of the alternative workstation 10 in respective open positions. As discussed herein above, in order for the side drawers 134 to be in their open positions, the first planar member 16 must be in its protracted position. For the workstation embodiment 200 wherein the tabletop includes a sink 205, the sink 205 and split-cavity water reservoir 207 are disposed within the housing of the workstation 200 at the location where one set of end drawers are disposed in other embodiments of the workstation, i.e., the sink assembly 204 and its components replace one set of end drawers 44 in the workstation embodiment including a sink assembly 205.

Any of the drawers 34, 44, 45 of either workstation 10, 110, 200, 300 may be arranged to accommodate hanging files, which are particularly helpful to teachers. Such a drawer would include channels disposed on opposite upper lateral sides of the drawer for receiving end hooks of hangers in which files may be placed. The Ordinary Artisan will understand how to construct a drawer arrangement adapted to accommodate hanging files, which construction is conventional.

If a hanging file drawer is provided, then side rails for support of the drawer when fully extended (i.e., fully open) preferably are provided. Such side rails include telescoping sections and are attached to sides of the drawer and to the chassis of the portable cart. Again, the Ordinary Artisan will understand how to construct such sliding rails for support of a drawer arrangement adapted to accommodate hanging files, which construction is conventional.

It is preferred that the end drawers 44 at the front of the workstation be arranged to accommodate hanging files.

Further, any of the drawers 34, 44, 45 of either workstation 10,110 may be insulated. In this regard, the lower side drawer 45 preferably is insulated in the workstation 10,110 so that cold items placed in this drawer 45 will tend to remain cold for a longer period of time than if placed in one of the non-insulated drawers 34,44; and so that hot items placed in the lower side drawer 45 will tend to remain hot for a longer period of time than if placed in one of the non-insulated drawers 34,44. For example, and not by way of limitation, the insulated drawer 45 may be used to keep dry ice for an experiment by a science teacher, or for simply preserving a teacher's lunch.

FIG. 11A and FIG. 11B are front end views of the workstation 10 showing the pass-through capability of the lower side drawer 45. As shown therein, the lower side drawer 45 is preferably a pass-through drawer, i.e., the lower side drawer 45 extends through the entire width of the 10 workstation and may be accessed from either side of the workstation 10.

In operation, the workstation 10 of the present invention is ideal for a floating teacher to use to move from classroom to classroom. The workstation 10 provides many conveniences that are not available in known workstations. The workstation 10 includes a plurality of drawers 34, 44, 45 for storing teaching supplies, with some of the drawers 34 being securable by lock 36 for storing sensitive information or personal items. The drawer configuration also may be arranged in various ways to personalize the workstation 10 for a particular teacher's needs.

The workstation 10 is easily movable, having large front 13 and back wheels 12, with the back wheels 12 being pivotable relative to the chassis 20 to aid in maneuverability. The handle 52 pivots to adjust for varying heights of users. At least one hand brake 50 is conveniently disposed on the handle 52 for controlling engagement of the workstation brakes 48. Each hand brake 50 is particularly user-friendly because of the way in which it controls the brake 48. By defaulting to a stable position, i.e., a position in which the brake 48 is engaged, a person using the workstation 10 will not have to be concerned with the workstation 10 accidentally rolling away or rolling out of control. Indeed, a user simply releases the hand brake 50 to stop the workstation 10 from moving.

Furthermore, as the workstation 10 preferably is approximately five feet in length, two and a half feet in width, and three feet in height and relatively heavy (although easily rolled along on a smooth surface), the workstation 10 has a relatively large momentum when put into motion and, if accidentally pushed (or intentionally pushed by a student, as the case may be), the workstation 10 could easily cause damage or injury. Use of brakes 48 disposed, by default, in a braking condition thereby precludes such errant movement of the workstation and safeguards against such damage or injury.

Further, the pivoting planar members 16,18 provide self-contained display spaces that are invaluable to a floating teacher. These planar members 16,18 may include a chalk board, a dry erase board, a bulletin board or many other display surfaces for the floating teacher to use. By having these self-contained display boards, a floating teacher no longer has to worry about finding space to display information needed for instruction.

In addition, the power outlets 56 provide an easily accessible power source, which allows a teacher greater freedom in where he or she may teach and greater freedom in the number of electronic devices that may be used in support of such teaching.

What is claimed is:

1. A portable workstation, comprising:

a. wheels for movement of the workstation;

b. a tabletop providing a work surface for the workstation;

c. a generally planar member; and d. a chassis joining the wheels, the tabletop, and the planar member, the chassis comprising the three dimensional support frame defining a shelving structure upon which a drawer is received and supported;

e. wherein, while joined to the wheels and the tabletop by the chassis, the planar member is moveable between, i. a protracted position, wherein a majority of the planar member extends above the tabletop, and ii. a retracted position, wherein a majority of the planar member does not extend above the tabletop;

f. wherein the drawer is disposed in sliding engagement with the support frame between an open position and a closed position; and g. wherein the planar member and the drawer are configured such that the planar member secures the drawer from moving from the closed position to the open position when the planar member is in the retraced position and the drawer is in the closed position; and h. wherein the tabletop defines the entire top surface of the portable workstation and includes therein a slot through which the planar moves when moving between the protracted position and the retracted position.

2. The portable workstation of claim 1, further comprising a lock moveable between a locked position, wherein the planar member is inhibited from moving from the retracted position to the protracted position, and an unlocked position, wherein the planar member is allowed to move from the retracted position to the protracted position.

3. The portable workstation of claim 1, further comprising a biasing member that biases the planar member in a direction from the retracted position toward the protracted position.

4. The portable workstation of claim 1, wherein access to the interior of the drawer is inhibited when the planar member is in the retracted position.

5. The portable workstation of claim 1, the drawer is removable from the support system when the planar member is in the protracted position.

6. The portable workstation of claim 1, wherein the planar member comprises a display surface.

7. The portable workstation of claim 1, wherein the planar member comprises a display surface on each of oppositely facing sides thereof.

8. The portable workstation of claim 1, wherein the planar member comprises a dry erase board.

9. The portable workstation of claim 1, wherein the planar member comprises a chalk board.

10. The portable workstation of claim 1, wherein the planar member pivots about a pivot axis between the retracted position and the protracted position.

11. The portable workstation of claim 1, wherein the pivot axis is orthogonally disposed to the plane of the planar member.

12. The portable workstation of claim 1, wherein the tabletop is removably joined to the support frame such that the tabletop may be replaced with the different tabletop.

13. The portable workstation of claim 1, further comprising a handle for facilitating movement of the planar member between the protracted position and the retracted position.

14. The portable workstation of claim 1, wherein the drawers of the workstation may be insulated.

15. A portable workstation, comprising;

a. wheels for movement of the workstation;

b. a tabletop providing a work surface for the workstation;

c. a first generally planar member;

d. a second generally planar member; and e. a chassis joining the wheels and the tabletop to the first and second planar members, the chassis comprising a three-dimensional support frame defining a shelving structure upon which a first plurality of drawers is received and supported on a first side of the chassis and a second plurality of drawers is received and supported on a second side of the chassis;

f. wherein, while joined to the wheels and the tabletop by the chassis, the first planar member is moveable between, i. a first planar member protracted position, wherein a majority of the first planar member extends above the tabletop, and ii. a first planar member retracted position, wherein a majority of the first planar member does not extend above r the tabletop, and wherein the first planar member secures the first plurality of drawers each from moving from a closed position to an open position; and g. wherein, while joined to the wheels and the tabletop, the second planar member is movable between, i. a second planar member protracted position, wherein a majority of the second planar member extends above the tabletop, and ii. a second planar member retracted position, wherein a majority of the second planar member does not extend above the tabletop, and wherein the second planar member secures the second plurality of drawers each from moving from a closed position to an open position.

16. The portable workstation of claim 15, wherein the first planar member pivots in a first rotational direction in moving from the first planar member retracted position toward the first planar member protracted position, and wherein the second planar member pivots in a second rotational direction, opposite to the first rotational direction, in moving from the second planar member retracted position toward the second planar member protracted position.

* * * * *